United States Patent [19]

Newman et al.

[11] 3,983,014

[45] Sept. 28, 1976

[54] ANODIZING MEANS AND TECHNIQUES

[75] Inventors: Frederick S. Newman, Sepulveda; John T. Hartman, Reseda; Francis A. Dedona, Sherman Oaks, all of Calif.

[73] Assignee: The Scionics Corporation, Culver City, Calif.

[22] Filed: Dec. 16, 1974

[21] Appl. No.: 533,333

[52] U.S. Cl. ..... 204/58; 204/228

[51] Int. Cl.[2] ..... C25D 11/04; C25D 11/08

[58] Field of Search ..... 204/DIG. 8–DIG. 9, 204/228 R, 58

[56] References Cited

UNITED STATES PATENTS

| | | | |
|---|---|---|---|
| 2,111,377 | 3/1938 | Wales | 204/58 |
| 2,901,412 | 8/1959 | Mostovych et al. | 204/58 |
| 2,951,025 | 8/1960 | Mostovych | 204/58 |
| 3,597,339 | 8/1971 | Newman et al. | 204/58 |

FOREIGN PATENTS OR APPLICATIONS

| | | | |
|---|---|---|---|
| 548,071 | 10/1957 | Canada | 204/58 |
| 1,090,840 | 11/1967 | United Kingdom | 204/58 |

*Primary Examiner*—R. L. Andrews
*Attorney, Agent, or Firm*—Lyon & Lyon

[57] ABSTRACT

In anodizing aluminum the primary power source is three phase which is converted into six phase and each current in each of such six phases flowing through an anodizing bath is controlled as to intensity and form with a large positive pulse followed by a smaller negative pulse and with the rate of such pulses being adjustable within the range of one to twenty per second for control of shade of the anodized aluminum.

10 Claims, 3 Drawing Figures

PRIMARY SOURCE ELECTRICAL POWER
10
3-PHASE POWER
POWER TRANSFORMATION
11
6-PHASE
18
CURRENT WAVE-FORM CONDITIONER
19
SENSOR
16
15
AL. MATERIAL
22
24
PROCESS TANK
$H_2SO_4$ SOLUTION
23
12
35
40
41
41A
41B
MAG. AMP. MEANS
ERROR AMP. MEANS
42
43
FREQUENCY CONVERTER
20
FREQUENCY CONTROL
34

12.5%
25%
25%
25%
12.5%
30
32
PULSE PERIOD 31
31A
30
32
33
33A

ANODIZING MEANS AND TECHNIQUES

The present invention relates to improved means and techniques useful in the production of an oxide coating on aluminum or the like in an anodizing bath.

An object of the present invention is to produce an improved anodizing system in which the primary power source is a multiphase source of alternating current.

Another object of the present invention is to provide an improved anodizing system wherein coatings of different darkness or lightness may be accomplished using pulses which are adjustable as to frequency for that purpose.

The features of the present invention which are believed to be novel are set forth with particularity in the appended claims. This invention itself, both as to its organization and advantages thereof, may be best understood by reference to the following description taken in connection with the accompanying drawings in which:

Figures 1, 2, 3:
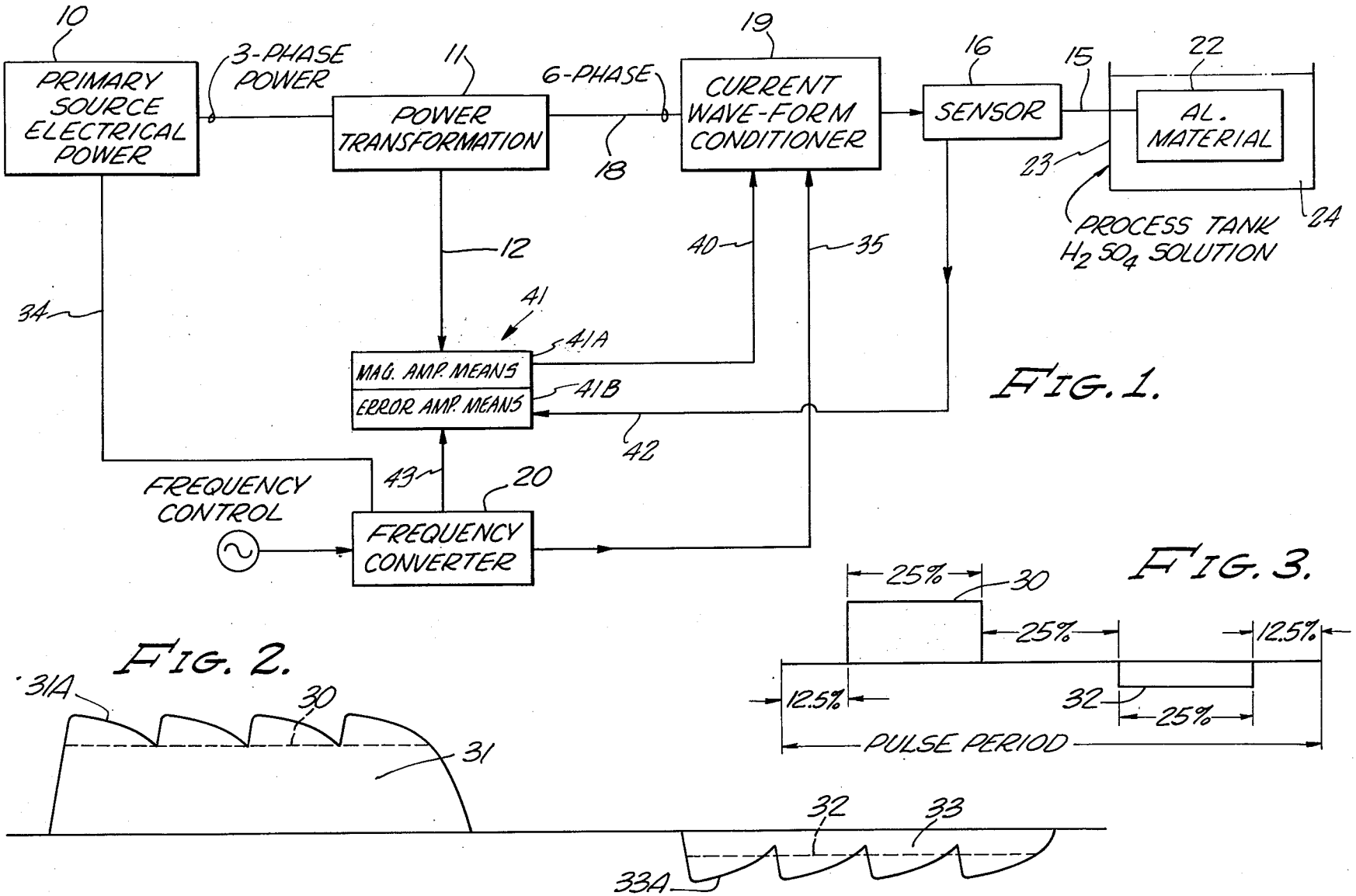
FIG. 1 illustrates a system embodying features of the present invention.
FIG. 2 illustrates a form of current wave produced in the system shown in FIG. 1.
FIG. 3 illustrates proportionate times during one pulse period.

The system illustrated is for what is referred to in the art as an anodizing system wherein an oxide coating is formed on aluminum or like material which is the anode in an electrolytic bath such as, for example, sulfuric acid containing oxygen which is used in the production of such oxide coating.

In FIG. 1, the aluminum anode 22 which is the part to be anodized is in the tank 23 as an anode containing a sulfuric acid bath 24. A current flows to such anode and through such tank to the metal tank which forms the cathode. Such current is in the form of a series of pulses. Each of such series of pulses includes a large positive composite current pulse illustrated by the area 31 followed by a succeeding smaller negative current composite pulse illustrated by the area 33 in FIG. 2. Each of such pulses 31, 33 as illustrated is in effect, formed by a plurality of pulses 31A, 33A produced in individual phases of the multi phase system.

Power for the system is derived from a commercial three phase source 10 which is connected to a power transformation stage 11 whose main output on line 18 is a six phase current. Such six phase current source 11 is connected to electrical circuitry typified in U.S. Pat. No. 3,597,339 and is referred to herein as a current wave form conditioner stage 19 which as illustrated therein involves a plurality of silicon controlled rectifiers that function in accordance with control signals supplied via lines 40 to produce controlled current waves. Such waves are controlled both as to form and intensity for each one of the six phases in the particular six phase system. The output current in each of the phases supplied to the aluminum part 22 is of the form shown in FIG. 2 with the characteristics as to relative intensity of the average 30 of the composite positive and average 32 of the composite negative portions 31 and 33, being as described in the U.S. Pat. No. 3,597,339 assigned to the same assignee as the present application.

The control 41 which develops that signal applied on lines 40 to control the current wave form conditioner 19 as described above receives a phase synchronous signal via line 12 and also error signals via line 42 from a current sensor 16 in that line 15 connected to the aluminum part 22.

This control 41 may involve magnetic amplifier means 41A or transformers receptive to the signal on line 12 as well as an error amplifier section 41B including pulse forming circuits receptive to an error signal applied via line 42. This control is also receptive to signals supplied via line 43 from a frequency converter stage 20.

The frequency converter stage 20 has an input signal supplied thereto from source 10 via line 34. Such converter stage 20 may include a frequency selectable programming counter for producing positive and negative enabling signals applied to control 19 via line 35.

The frequency converter stage 20 converts the frequency of source 10 to a frequency which is selectable within the range of 1 to 20 hertz. The output of the frequency converter 20 enables pulses from the above mentioned magnetic amplifiers or pulse transformers in control 41 such that the duration of the pulses supplied to the current wave form conditioner 19 correspond to one of the selected frequencies, i.e., a frequency between 1 and 20 hertz per phase. In the six phase system this means a range of positive pulses 30 between 1 and 20 per second applied to the anodized part 22 in the bath 24.

As indicated previously, the current in line 15 is sensed by a sensor 16 and the control is such that the output current of the wave form conditioner stage 19 is maintained at substantially constant intensity.

The control 41 involving error amplifying means and pulse forming circuits operate to modify the phase relationship between phase synchronous signals from the power transformation stage 11 and the pulses supplied to current wave form conditioner stage 19 to maintain positive and negative pulses, shown in FIG. 2, of constant intensity and frequency.

FIG. 3 illustrates generally, in approximate relationship, the overall result where during a cycle represented by the pulse period having a duration designated as such for comparison purposes, the positive current flows for 25% of the pulse period, negative current flows for 25% of the pulse period, a dead time of 25% exists between the cessation of a positive pulse and the beginning of a negative pulse and there is a dead time of 25% between cessation of the negative pulse and the beginning of the positive pulse.

The positive pulse 30 is, as seen in FIG. 2, the average of a multiplicity of pulses derived from individual phases and likewise, the negative pulse 32 is the average of a multiplicity of pulses derived from individual phases.

The apparatus functions to select the number of individual pulses 31A used in establishing the time duration of the average pulse 30 and likewise, the number of individual pulses 33A used in establishing the duration of the average pulse 32. Each individual pulse 31A and each individual pulse 33A corresponds generally to a time duration of 0.0166/6=0.00278 seconds. By selecting the number of individual pulses 31A, 33A, the pulse repetition rate measured in terms of pulses per second and this selection, is such that the pulse repetition rate is within the desired range of one to 20 pulses per second for shade control of the anodized part.

The ratio of intensity of average negative current (averaged over an entire pulse period) to average positive current (average over an entire pulse period) is within the range claimed in the above mentioned patent i.e., within the range of three but less than twenty percent.

While the particular embodiments of the present invention have been shown and described, it will be obvious to those skilled in the art that changes and modifications may be made without departing from the invention in its broader aspects and therefore, the aim in the appended claims is to cover all changes and modifications as fall within the true spirit and scope of this invention.

We claim:

1. In a multi-phase anodizing system in which it is desired to produce an oxide coating on aluminum or the like in an anodizing bath using energy derived from a multi-phase source, wherein the improvement comprises modifying a multiphase current derived from said source to supply positive and negative current pulses alternately through said bath with the ratio of average negative current to average positive current being greater than approximately three percent but less than twenty percent and with the frequency of such positive and negative pulses in each phase being one or more pulses per second and with the frequency of such positive and negative pulses in each phase being less than the frequency of said multi-phase source from which said multiphase current is derived.

2. A system as set forth in claim 1 in which the negative current is caused to flow after a time interval after cessation of positive current flow during which time interval neither positive nor negative current flows.

3. The improvement as set forth in claim 1 wherein said bath is a sulphuric acid bath of concentration by volume in the range of 5 to 25 percent.

4. A system as set forth in claim 2 in which the positive current is caused to flow after a second time interval after cessation of negative current flow during which second time interval neither negative nor positive current flows.

5. A system as set forth in claim 2 in which the negative current is automatically and continuously maintained at a constant average value regardless of voltage or resistance variations in that path through which said current flows.

6. A system as set forth in claim 4 in which the positive current is automatically and continuously maintained at a constant average value regardless of voltage or resistance variation in that path through which said current flows.

7. A system as set forth in claim 4 in which both the positive current and the negative current is automatically and continuously maintained at a constant value regardless of voltage or resistance variations in that path through which said positive and negative current flows.

8. A system as set forth in claim 1 in which said multiphase current is derived from a multiphase source which has a lesser amount of phases than said multiphase current.

9. A system as set forth in claim 1 in which the number of pulses per second may be adjusted.

10. A system as set forth in claim 1 in which said positive and negative pulses are each a composite of a number of pulses of shorter duration.

* * * * *